United States Patent [19]

Jarus

[11] Patent Number: 5,052,194

[45] Date of Patent: Oct. 1, 1991

[54] EAR HIDERS

[76] Inventor: Albert J. Jarus, 8201 Bay Pkwy. Apt. 2-H, Brooklyn, N.Y. 11214

[21] Appl. No.: 656,684

[22] Filed: Feb. 19, 1991

[51] Int. Cl.[5] ..... A44C 7/00

[52] U.S. Cl. ..... 63/14.3; 63/14.5; 2/209

[58] Field of Search ..... 2/209, 423; 63/14.1, 63/14.3, 14.4, 14.5, 14.8; 128/864

[56] References Cited

U.S. PATENT DOCUMENTS

| | | | |
|---|---|---|---|
| 2,111,147 | 3/1938 | Jonas | 2/209 |
| 2,428,897 | 10/1947 | Ungemah | 2/209 |
| 3,354,471 | 11/1967 | Longo | 2/209 X |

FOREIGN PATENT DOCUMENTS

| | | | |
|---|---|---|---|
| 169221 | 10/1951 | Austria | 63/14.5 |
| 207686 | 12/1965 | Fed. Rep. of Germany | 63/14.5 |
| 72420 | 4/1960 | France | 63/14.5 |
| 66521 | 10/1948 | Norway | 2/209 |

*Primary Examiner*—James R. Brittain

*Attorney, Agent, or Firm*—Goodman & Teitelbaum

[57] ABSTRACT

Human ear hiders are designed to be comfortably worn and will enhance the appearance of a wearer, where each ear hider includes a pair of wire frames coupled together and having finger grip portions for spreading apart a bead and seat member of an assembly. The bead and seat member serve to engage and support the ear hiders on the ears. The frames are secured to a face of a plate that is also secured to a simulated bird wing of bright colors, and a spring is provided in the assembly for retaining the ear hider in a clamped position.

6 Claims, 1 Drawing Sheet

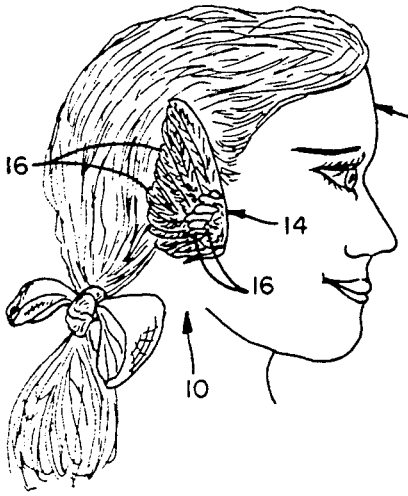
FIG.1
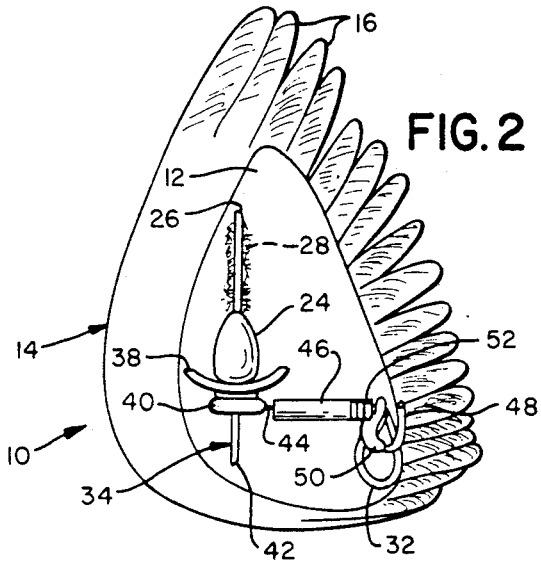
FIG. 2
FIG. 3
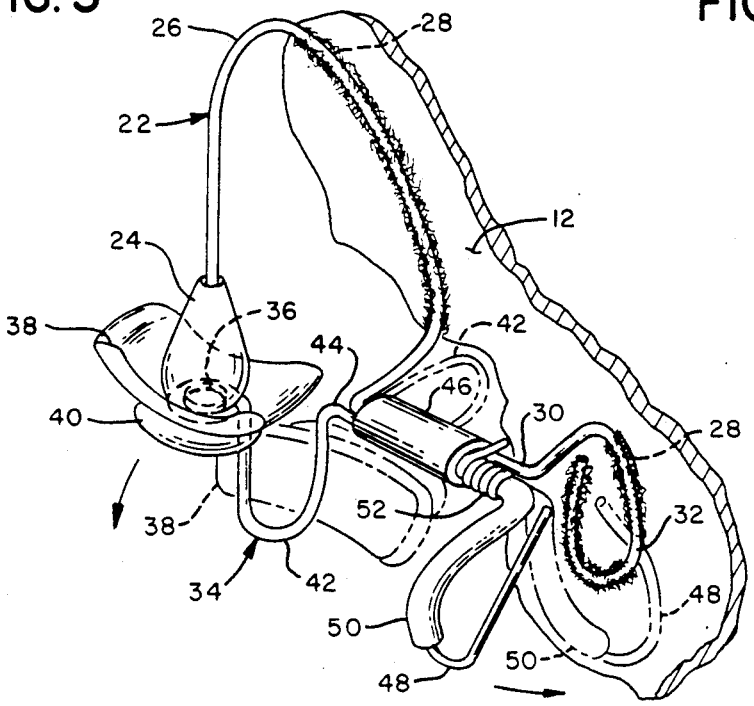
FIG. 4
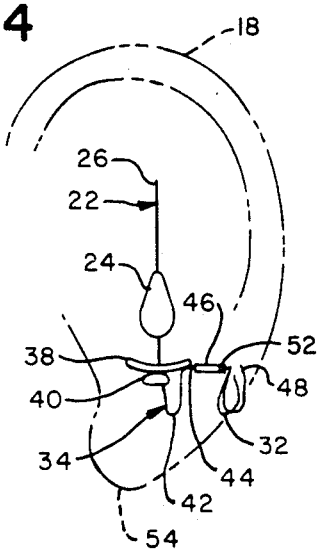

EAR HIDERS

CROSS-REFERENCE TO RELATED APPLICATION

This is a refile of U.S. Ser. No. 07/201,464, filed Apr. 2, 1988, abandoned.

BACKGROUND OF THE INVENTION

The instant invention relates generally to decorative ear devices, and more particularly, to human ear hiders.

Numerous ornaments have been provided in the prior art that are adapted to be attached to a person's ears. For example, U.S. Pat. Nos. 3,958,430 of Barron, 3,354,471 of Longo, 3,041,856 of Neal, and 2,526,087 of Schoolman et al, all are illustrative of such prior art. While these units may be suitable for the particular purpose to which they address, they would not be as suitable for the purpose of the present invention as hereafter described.

SUMMARY OF THE INVENTION

A primary object of the present invention is to provide human ear hiders that will overcome the shortcomings of the prior art devices.

Another object is to provide ear hiders that will be of such design, as to be inserted into an area just above the auditory canal of the human ear.

An additional object is to provide ear hiders that will be of such design, as to have a pair of loop levers for securing and releasing the devices to a person's ears.

A further object is to provide ear hiders that are simple and easy to use, do not effect the individual's hearing, and do not swing about as the wearer turns his/her head rapidly, thereby eliminating a nuisance.

A still further object is to provide ear hiders that are economical in cost to manufacture, and may be of many designs other than the simulated bird's wing illustrated in the drawings, and may even be such as to allow the wearer to place their own design on the ear hider.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the present invention.

BRIEF DESCRIPTION OF THE DRAWING FIGURES

The figures in the drawings are briefly described as follows:

FIG. 1 is a side view of the instant invention shown in use;

FIG. 2 is a rear elevational view of the invention per se;

FIG. 3 is an enlarged fragmentary perspective view of the clamp mechanism of the invention shown in closed position, and further illustrated in an open position in phantom; and FIG. 4 is a diagrammatic view of the clamp portion illustrated mounted on a wearer's ear.

DETAILED DESCRIPTION OF THE PREFERRED EMBODIMENT

Turning now descriptively to the drawings, in which like reference characters denote like elements throughout the several views, a human ear hider ornament 10 is shown in FIG. 2 to include a wing shaped mounting plate 12 fabricated of a light weight material, and one surface of the plate 12 is fixedly secured to one surface of a simulated bird's wing 14 or other decorative ornament by a suitable adhesive (not shown). The wing 14 is provided with a plurality of brightly colored feathers 16 and is designed to cover the ears 18 of a wearer 20, for enhancing their overall appearance, as shown in FIG. 1.

As shown in FIG. 3, the plate 12 also provides for the mounting of a first wire frame 22 having one end fixedly secured in one end of a bead 24 that is employed for a purpose which hereinafter will be described. A horizontal portion 30 is formed at a lower portion of a large vertical loop 26 of the first wire frame 22, and is terminated by an end loop 32 of a smaller size that is secured by an adhesive 28 to the plate 12 and serves as one of the finger levers for attaching or removing the ear hider ornament 10.

A second wire frame 34 is provided and one end is tightly looped around a stem 36 integrally attached to a center portion of a convex bottom of a curved seat member 38 having a concave upper portion that cooperates with the bead 24 for securing the ornament 10 to the human ear 18. A knob portion 40 is also integrally attached to a bottom end of the stem 36, so as to prevent the looped portion of second wire frame 34 from coming off of the seat member 38. A vertical small loop 42 is formed opposite to the large loop 26, and a horizontal portion 44 extending therefrom is aligned parallel with the horizontal portion 30 of first wire frame 22. A tubular sleeve 46 binds the horizontal portion 30 and the horizontal portion 44 together.

An end loop 48 terminates the second wire frame 34. The end loop 48 serves as a pivotal second finger lever that is employed in cooperation with the end loop 32 of the first wire frame 22, to attach and disconnect the ornament 10 to the human ear 18 by finger pressure of the wearer 20.

A flexible sleeve 50 is received on a portion of the end loop 48 for comfort to the wearer 20 when depressing the end loop 48. A coil spring 52 is received on horizontal portion 44 and is held in place thereto at one end by the tubular sleeve 46. The other end of spring 52 engages with the horizontal portion 30 of the first wire frame 22. The above arrangement serves to return the pivotal end loop 48 to its normal outward position for urging the bead 24 towards the seat member 38, and it is recognized that the end loop 32 remains stationary with respect to the plate 12 when attaching and disconnecting the ornament 10.

In use, the end loops 32 and 48 are employed between the thumb and index fingers of the wearer 20, and when pressed together, the end loop 48 pivots towards the end loop 32. The above action causes the second wire frame 34 to pivot the seat member 38 away from the bead 24 of the first wire frame 22, enabling the ornament 10 to be positioned with the supporting curved seat member 38 disposed behind the ear lobe 54 and under the ear 18, as shown in FIG. 4. When pressure is released by the wearer's fingers, the bead 24 will engage or seat against a bottom portion of the ear 18, and the spring pressure of the spring 52 will keep the ornament 10 in position comfortably. When it is desired to remove the ornament 10, the reverse procedure is affected.

While certain novel features of this invention have been shown and described, it will be understood that various omissions, substitutions and changes in the forms and details of the device illustrated and in its operation can be made by those skilled in the art without departing from the spirit of the invention.

What is claimed is:

1. An ear cover comprising:

a mounting plate having an inside and an outside and adapted to cover a human ear;

a decorative cover secured to said outside of said mounting plate serving as a means for covering a human ear;

a first frame comprising a first length of wire having an intermediate portion secured in a substantially vertical line on said inside of said mounting plate, a curved portion extending outwardly from a top of said intermediate portion and terminating in a bead having a curved lower end, a first horizontal wire portion attached to a bottom end of said intermediate portion and extending horizontally along said inside of said mounting plate and adjacent thereto, and a wire loop portion connected to an end of said first horizontal wire portion and secured to said inside of said mounting plate;

a second frame comprising a curved seat member having a concave upper portion adapted to engage said curved lower end of said bead, said curved seat member having a convex bottom, a stem connected at one end to said convex bottom of said curved seat member with a knob at the other end of said stem, and a second length of wire attached to and extending from said stem to form a second horizontal wire portion parallel and immediately adjacent to said first horizontal wire portion of said first frame, said second frame being adapted for movement relative to said first frame so that said curved seat member is movable relative to said bead;

connecting spring means for forcing said curved seat member into engagement with said bead, said connecting spring means engaging both said first horizontal wire portion of said first frame and said second horizontal wire portion of said second frame; and lever means connected with said second frame and being actuatable to produce movement of said second frame relative to said first frame so that said curved seat member is separated from said bead to thereby attach said ear cover to a human ear.

2. An ear cover according to claim 1, wherein said connecting spring means includes a tubular sleeve surrounding both said first and second horizontal wire portions, said second horizontal wire portion being pivotable therein, and a coil spring having two ends with one end held secured to said second horizontal wire portion by said tubular sleeve and the other end of said coil spring engaging said first horizontal wire portion.

3. An ear cover according to claim 1, and further including a second wire loop portion formed from an extension of said second horizontal wire portion, said second wire loop portion forming said lever means adapted for moving said second frame relative to said first frame against an opposing force provided by said connecting spring means upon an application of pressure to said second wire loop portion.

4. An ear cover according to claim 3, and further including a sleeve member covering at least a portion of said second wire loop portion.

5. An ear cover as in claim 1, wherein said second length of wire further includes a curved portion connected between said stem and said second horizontal wire portion.

6. An ear cover as in claim 1, wherein said decorative cover is a simulated bird's wing.

* * * * *